US006598380B1

(12) United States Patent
Sgubbi

(10) Patent No.: US 6,598,380 B1
(45) Date of Patent: Jul. 29, 2003

(54) METHOD FOR PACKAGING ORDERED GROUPS OF PRODUCTS AND THE RELATIVE CARTONING DEVICE

(75) Inventor: Cristian Sgubbi, Imola (IT)

(73) Assignee: I.M.A. Industria Macchine Automatiche S.p.A., Dell 'Emilia (IT)

( * ) Notice: Subject to any disclaimer, the term of this patent is extended or adjusted under 35 U.S.C. 154(b) by 46 days.

(21) Appl. No.: 09/617,802

(22) Filed: Jul. 17, 2000

(30) Foreign Application Priority Data

Jul. 30, 1999 (IT) ..... BO99A0438

(51) Int. Cl.[7] ..... B65B 5/06; B65B 7/22

(52) U.S. Cl. ..... 53/566; 53/251; 53/284; 53/377.5

(58) Field of Search ..... 53/251, 377.5, 53/566, 284

(56) References Cited

U.S. PATENT DOCUMENTS 1,177,719 A * 4/1916 Milmoe ..... 53/566
1,571,716 A * 2/1926 Fishwick ..... 53/566
1,621,516 A * 3/1927 Milmoe ..... 53/377.5
1,935,269 A * 11/1933 Jones ..... 53/377.5
2,314,434 A * 3/1943 Toelke ..... 53/566
2,380,758 A * 7/1945 Hohl ..... 53/377.5
3,412,652 A * 11/1968 McIntyre ..... 53/566
3,443,357 A * 5/1969 Bacon ..... 53/566
4,869,052 A * 9/1989 Calvert ..... 53/566
5,127,894 A * 7/1992 Maccaferri ..... 53/566

* cited by examiner

*Primary Examiner*—John Sipos
(74) *Attorney, Agent, or Firm*—Arent Fox Kintner Plotkin & Kahn

(57) ABSTRACT

A method and the relative device for packaging ordered groups of products in a carton comprises the following stages: feeding one carton at a time, in the form of a flat pre-folded blank, to a loading table and simultaneous opening of the blank, by means, to form a tubular carton body with two opposite openings one on either side, two first pairs of smaller flaps and two second pairs of larger flaps or lids; folding of the two pairs of smaller flaps, by first means, during carton feed in a preset direction, so as to form a first partial closure of the openings; and closing of the carton body, by second means, by simultaneous folding of the pair of lids towards the two openings so as to obtain a closed package. FIGS. [1–7]

19 Claims, 9 Drawing Sheets

METHOD FOR PACKAGING ORDERED GROUPS OF PRODUCTS AND THE RELATIVE CARTONING DEVICE

BACKGROUND OF THE INVENTION

The present invention relates to a method for making cartons for packaging ordered groups of products and the relative cartoning device.

In particular, the method and device disclosed refer to cartons for packaging ordered rows of filter bags for tea, chamomile, or other products for infusion.

In the sector of automatic packaging machines for products for infusion in filter bags, and in particular those machines with medium—low productivity, there is not always a cartoning device for preset groups of filter bags attached directly to the packaging machine or connected directly to said machine by feed devices.

Machines with this type of productivity are, for example, but without limiting the scope, those used to make single lobe filter bags, that is to say, bags with a single chamber which holds the product for infusion, with heat-sealing on three edges of the filter bag and folding of the fourth edge, and with a pickup tag and thread to aid infusion attached to the filter bag.

For such machines, cartoning can often be done manually by an operator, or in an independent station of the filter bag machine.

In contrast, the use of cartoning devices is common on high quality and high productivity machines. The devices are located downstream of a final station on the filter bag machine. This final station is designed to prepare a given number of filter bags (normally in rows consisting of a preset number) and transfer them into cartons for collective packaging, formed and suitably positioned by the device.

These devices comprise numerous devices for automatic handling of the cartons in order to perform the following stages in succession and with a high level of productivity: picking up the cartons in the form of flat blanks from a feeder; transferring the cartons to an erecting station equipped with a fixed hopper and a mobile rod which interact for three-dimensional carton erection (which may include gluing); feeding the open cartons to a filling station; closing the cartons by folding the lid and, finally, moving the cartons full of products towards a station at which they are ejected from the cartoning device.

This succession of stages is performed in several stations equipped with conventional (that is to say, mechanical or pneumatic and mechanical) pickup, release, folding and movement devices which allow carton feed during its three-dimensional erection and subsequent feed in steps suitably synchronized with the rest of the machine according to the number of filter bags to be cartoned.

These cartoning devices operate in a satisfactory manner and are highly reliable. However, the particular construction and the type of mechanical technology used for their automatic handling devices makes their construction quite complex and expensive when designed for the type of packaging machines described above, as well as necessitating a large space for installation of the device close to the packaging machine.

For this reason, it became necessary to simplify the method for forming the cartons used for packaging the filter bags and to envisage an extremely compact cartoning device which requires very little space even for the carton handling parts, to allow a reduction in the space required on the packaging machine and to cut the costs of the machine.

SUMMARY OF THE INVENTION

Accordingly, the present invention provides a method for packaging one or more rows of filter bags in cartons which comprises a stage of feeding one carton at a time, in the form of a flat pre-folded blank, on a loading table, simultaneously erecting the blank, to form a tubular carton body with two opposite openings, one on either side, two first pairs of smaller flaps and two second pairs of larger flaps or lids. The two pairs of smaller flaps are folded over following insertion of the filter bags in the carton body, as it is fed along in a preset carton direction of feed, to form a first partial closure of the openings. Finally, the carton body is closed by simultaneous folding of the pair of lids towards the two openings to obtain a closed package.

BRIEF DESCRIPTION OF THE DRAWINGS

The invention will now be described in further detail with reference to the accompanying drawings, which illustrate preferred embodiments of it by way of example and in which.

DESCRIPTION OF THE PREFERRED EMBODIMENTS

Figure 1:
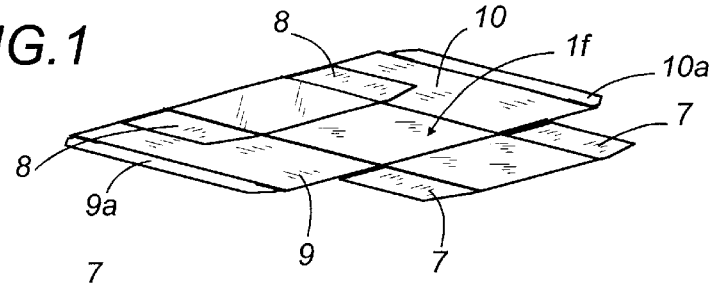
FIGS. 1 to 7 are schematic perspective views of a succession of stages of the method for packaging ordered groups of products in a carton, in accordance with the present invention.

With reference to the accompanying drawings and in particular FIGS. 1 to 8, the method disclosed, and the relative device which implements it, allow the packaging of ordered groups of products in a carton 1.

More specifically, the cartons 1 used are specifically for packaging filter bags 2 containing doses of products for infusion such as tea, chamomile and the like, made on automatic machines which also comprise a station for forming a group consisting of a preset number of filter bags 2, arranged in a row F. Only the end of this station is illustrated, as indicated below, since the remaining elements of the station are of the known type and are not part of the subject matter of the present invention.

The machine to which the device described may be applied is not illustrated, since it may be of any productive type without the present invention losing its originality.

As illustrated in FIGS. 1 to 7, the method consists of the following main stages:

feeding one carton 1 at a time, in the form of a flat pre-folded blank 1*f* (see FIG. 1), on a loading table 4, with simultaneous opening of the blank 1*f* by relative means 5 to form a tubular carton body 6 (see FIG. 2) with two opposite openings 6*a* and 6*b*, one on either side, two first pairs of smaller flaps 7 and 8 and two second pairs of larger flaps or lids 9 and 10;

folding the two pairs of smaller flaps 7 and 8, by relative means 11, as the carton 1 is fed in a preset direction A (see FIG. 3), to form a first partial closure of the openings 6*a* and 6*b;* closing the carton body 6, using second means 12, by simultaneously folding the pair of lids 9 and 10 towards the two openings 6*a* and 6*b* to obtain a closed package (see FIGS. 4 to 7).

Figure 2:
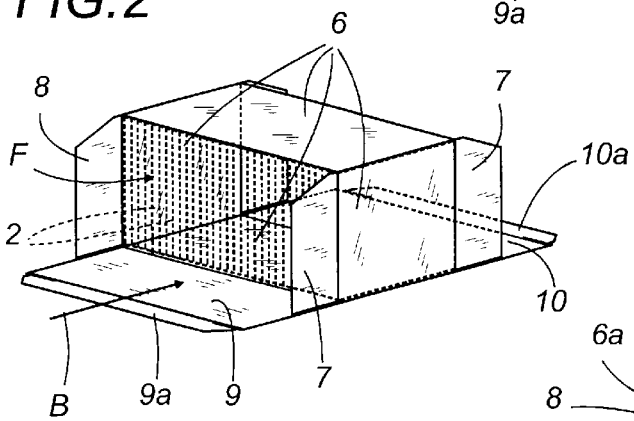

As illustrated in FIG. 2, the stage of feeding a flat pre-folded blank 1*f* and forming the tubular carton body 6, and the stage of folding the first pair of smaller flaps 7 and 8 are separated by a stage of feeding a row F of products into the carton body 6 in a direction of feed indicated by the arrow B.

Figure 9:
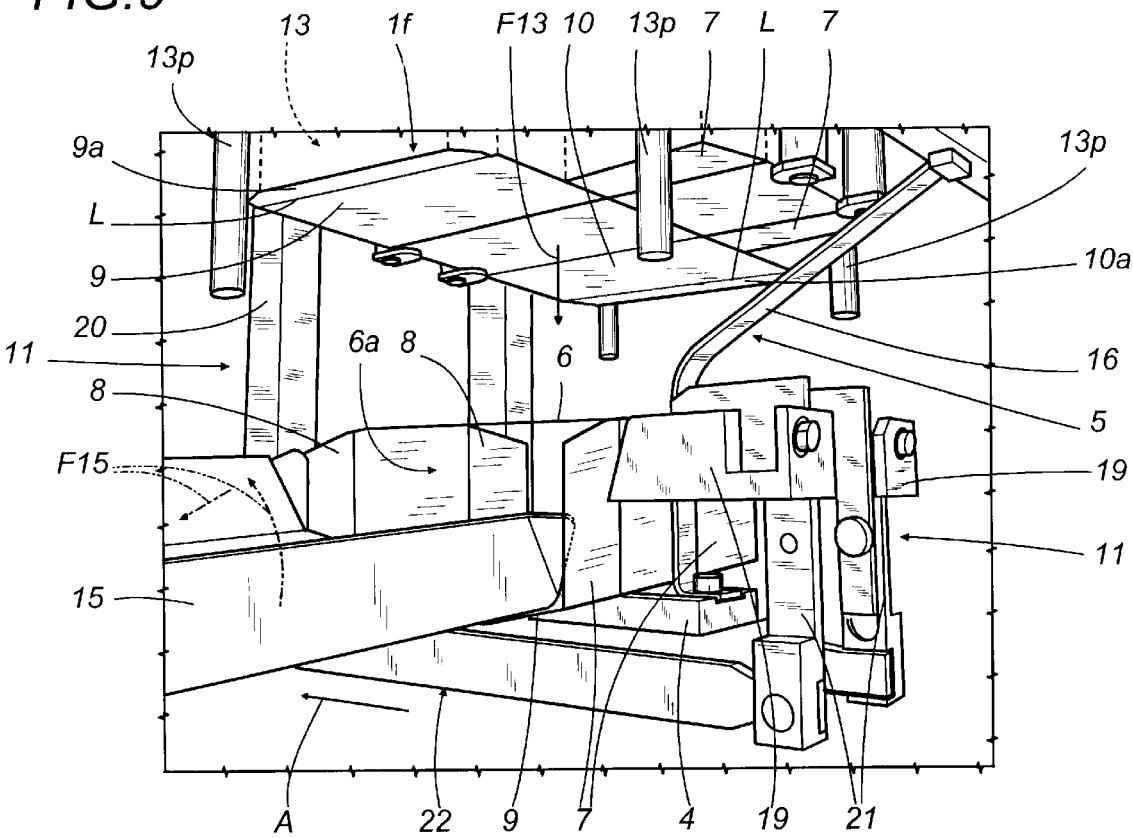
FIG. 9 is a perspective view of a detail G illustrated in FIG. 8.
Figure 10:
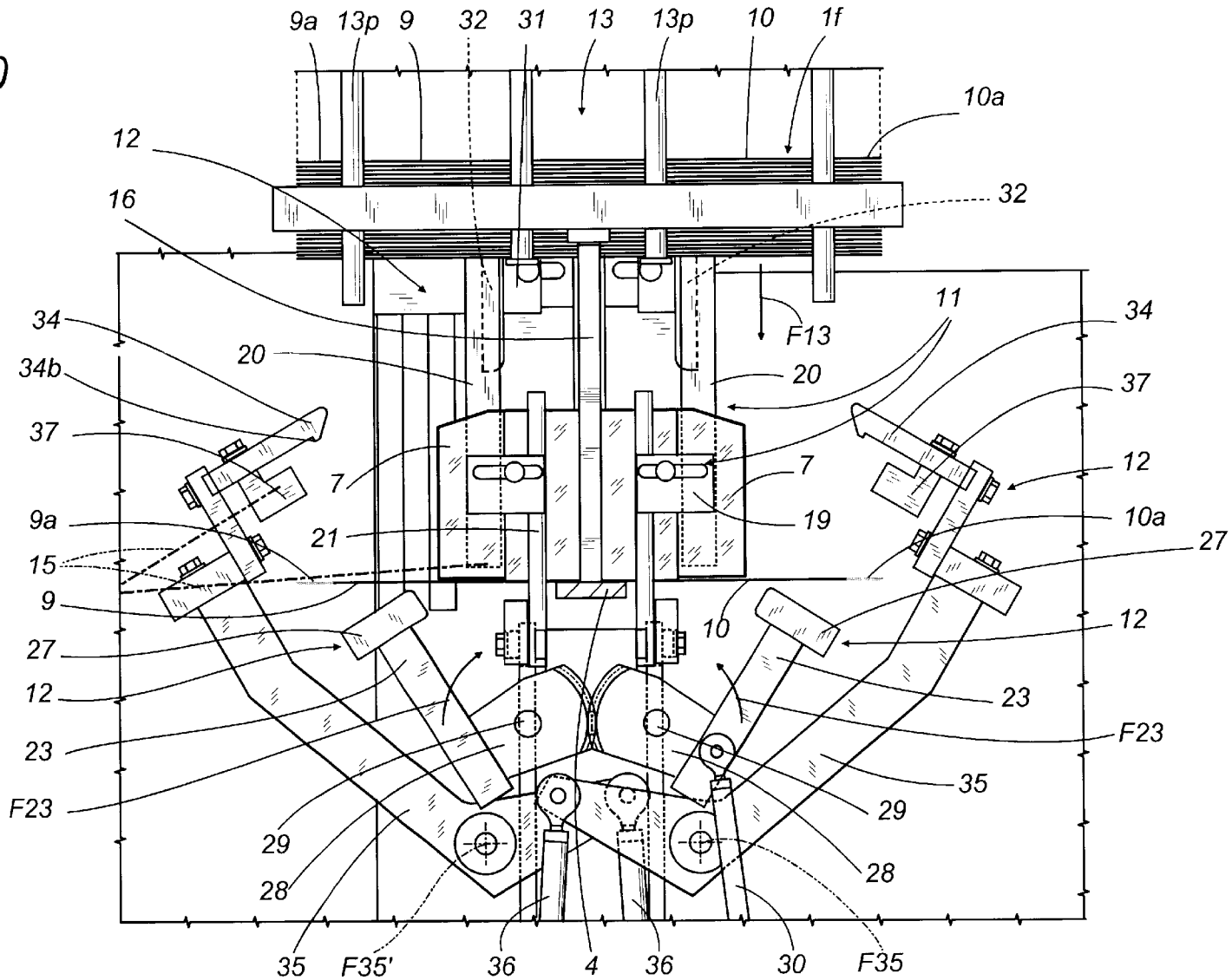
FIG. 10 is a front view, from P in FIG. 8, of a first, loading, station on the device illustrated in FIG. 8.
Figure 18:
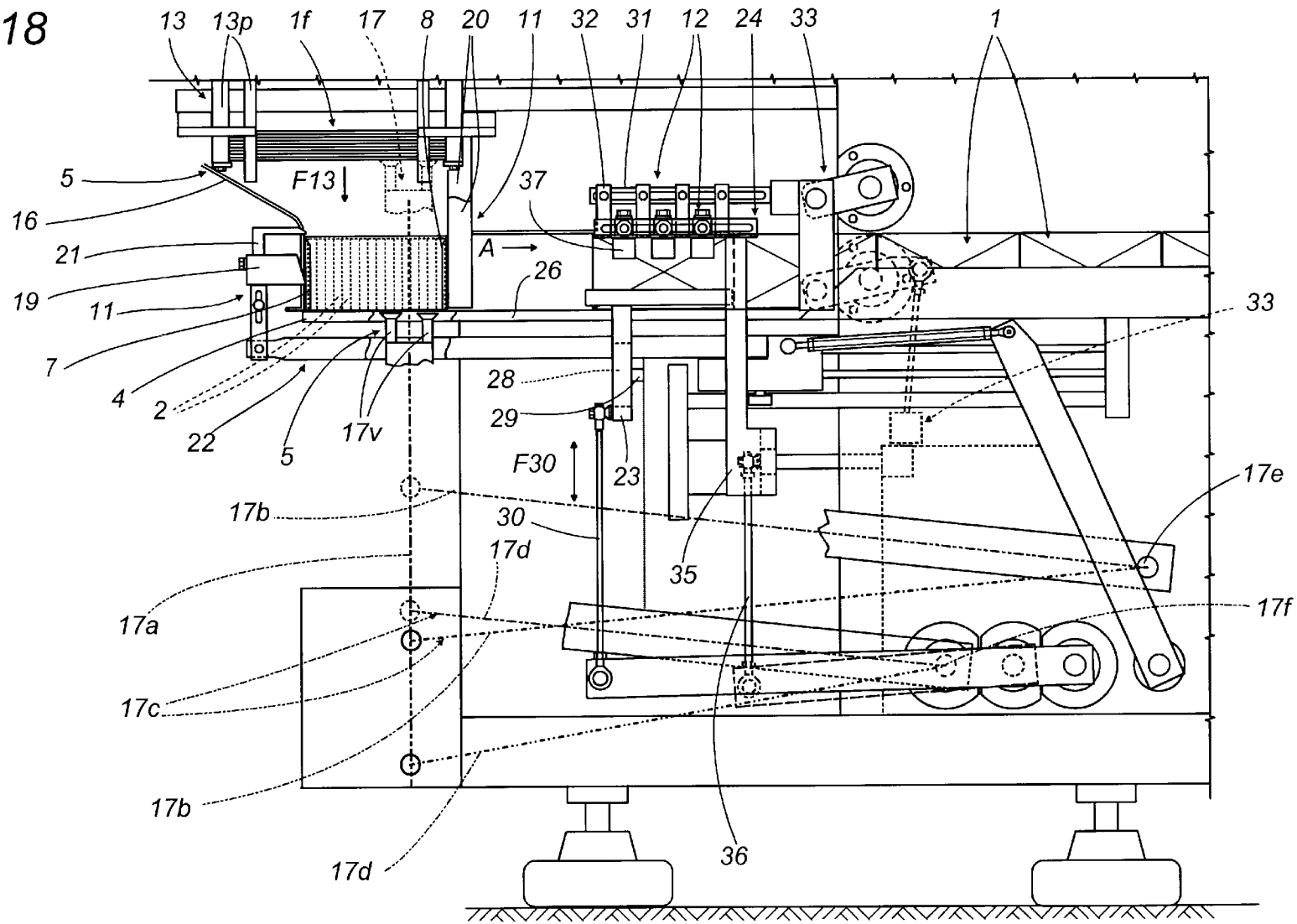
FIG. 18 is a side view from N in FIG. 8 of the device illustrated in FIG. 8.

Said feed stage is carried out by picking up, from above, an individual flat pre-folded blank 1*f* which is in a stack in the blank 1*f* magazine 13 (see also FIGS. 9, 10, 18 and arrows F13).

Figure 3:
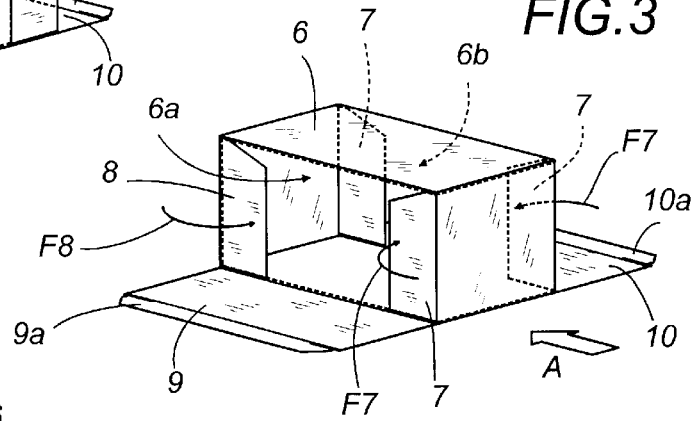
Figure 4:
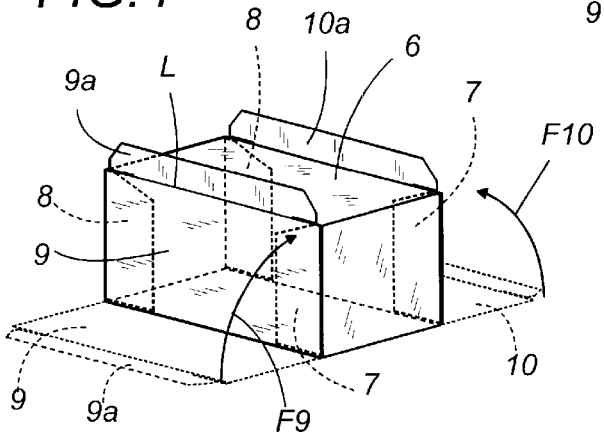

As illustrated in FIG. 3, the above-mentioned stage of folding the first pair of smaller flaps 7 and 8 (indicated with arrows F7 and F8) is carried out by feeding the carton in a direction A perpendicular to the direction of feed B of the row F of products.

More precisely, the stage of folding the first pair of smaller flaps 7 and 8 envisages a folding rotation, simultaneous and by contrast, of one flap 7 in each pair, located on one side of the carton body 6, and a successive folding rotation, again by contrast and during translation of the carton body 6, of the other flaps 8 in each pair, located on the opposite side of the carton body 6 (closure further described below).

The stage of closing the carton body 6 envisages a succession of sub-stages comprising simultaneous folding of the pair of lids 9 and 10 (see FIG. 4 and arrows F9 and F10), from a horizontal position, in which the lids 9, 10 are distanced from the carton body 6, to a position in which the lids 9, 10 are substantially vertical and make contact with the carton body 6. When the lids 9 and 10 have reached the vertical position, the free ends 9*a* and 10*a* of each lid 9 and 10 are simultaneously folded.

Figure 5:
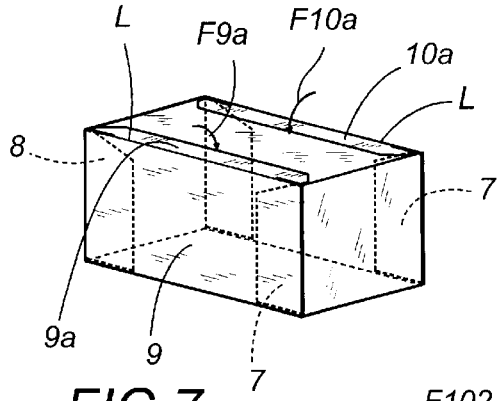

In order to fold the ends 9*a* and 10*a* correctly, the lids 9 and 10 have a pre-weakened fold line L, forming an end tab 9*a* and 10*a* which is joined to the carton body 6 and is angled relative to the rest of the lid 9 and 10 (see FIG. 5 and arrows F9*a* and F10*a*).

Figure 6:
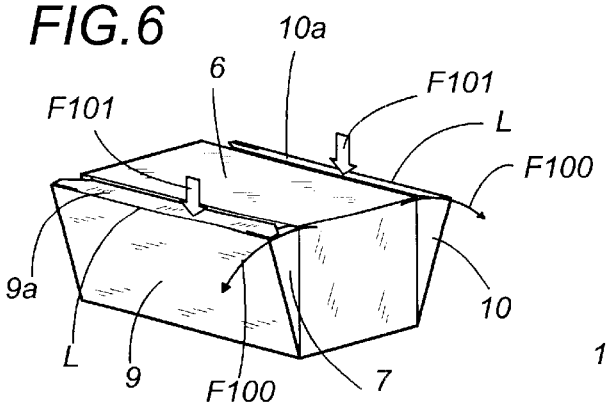

Once the end tabs 9*a* and 10*a* have been formed, the lids 9 and 10 are simultaneously moved away from the carton body 6 by a rotation in the opposite direction to the previous folding rotation (see FIG. 6 and arrows F100).

Figure 7:
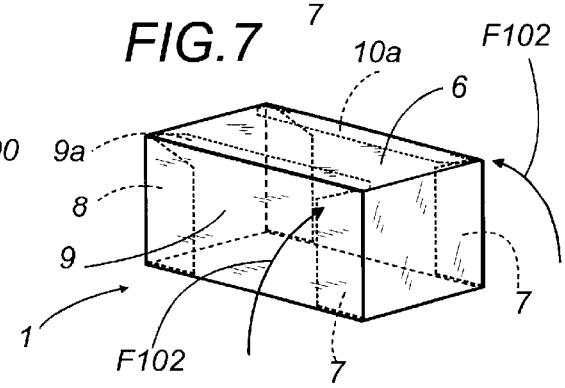

At this point the end tabs 9*a* and 10*a* are simultaneously pressed and held in this position (see arrows F101 in FIG. 6) to allow the lids 9 and 10 to be simultaneously moved towards the carton body 6 again, with insertion of the tabs 9*a* and 10*a* into the openings 6*a* and 6*b* in the carton body 6, to close the carton 1 (see arrows F102 in FIG. 7).

The method described above is implemented by a device attached to the automatic machine, said device comprising: means 5 for forming an individual carton body 6, first folding means 11 and second folding means 12.

Figure 8:
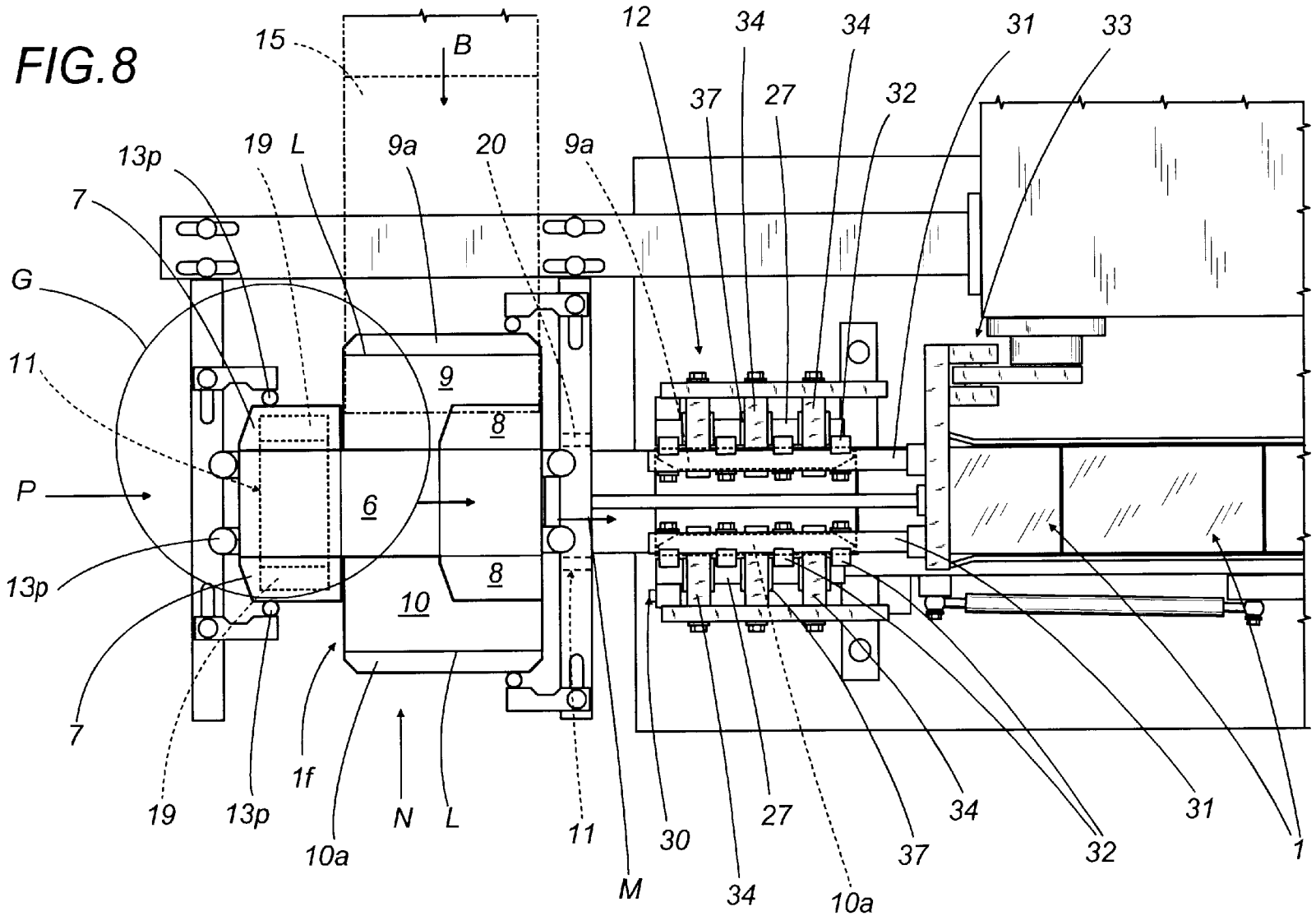
FIG. 8 is a schematic top plan view, with some parts cut away to better illustrate others, of a device that implements the method for packaging ordered groups of products, applied to an automatic machine which makes said products.

As illustrated in FIGS. 8, 9 and 10, the means 5 allow the formation of one tubular carton body 6 at a time, which as already indicated, is fed in the form of a flat pre-folded blank if from a magazine 13. The magazine 13 comprises a stack of blanks if arranged one on top of another and held in place by a tube-like structure 13*p*, above a loading table 4, and having means 17 for picking up an individual blank if on the loading table 4 (see arrow F13 in FIGS. 9 and 18).

More specifically with reference to the technical details, the means 5 which form the carton body 6 comprise a suction cup unit 17 which picks up the blank 1*f* from the pile or stack of blanks and a rigid rod 16 which erects the individual blank 1*f*.

The suction cup unit 17 (clearly visible in the schematic view in FIG. 18) consists of a support arm 17*a* with one free end, at least one pair of suction cups 17*v* for picking up the blank 1*f* from the stack in the magazine 13. The arm 17*a* is operated by drive means 17*c* consisting of a pair of rods 17*b* and 17*d* which, together with the arm 17*a*, form a four-bar linkage connected to internal mechanisms (of the known type and therefore not illustrated) by their relative ends 17*e* and 17*f*. This pair of rods 17*b* and 17*d* moves the arm 17*a*, in both directions and synchronized with the rest of the machine, between a pickup end position, in which the pair of suction cups 17*v* makes contact with a blank if in the stack (see dashed line in FIG. 18), and a release position, in which the pair of suction cups 17*v* is below the loading table 4, releasing the blank 1*f* onto the latter (see the continuous line and arrow F13 in FIG. 18).

During its descent, the blank 1*f* intercepts the rigid rod 16 which forms a shaped guide, located close to the loading table 4 so as to allow part of the surface forming the carton body 6 to rotate upwards, resulting in erection of the blank 1*f*.

The means 5 (see FIGS. 9 and 10) allow the formation of a carton body 6 with two openings 6*a* and 6*b*, one opposite the other, on either side, with the two first pairs of open smaller flaps 7 and 8 and two second pairs of larger flaps or lids 9 and 10, in an extended configuration, allowing at least one row F of products to be inserted in the carton.

The carton body 6 thus positioned on the loading table 4 has one opening 6*a* opposite the end of a passage 15 for the row F of products, which is part of the last station on the machine, allowing the row F of products to be fed into the carton body 6 in direction of feed B perpendicular to the direction A of movement of the carton 1.

The end of the passage 15 moves between a lowered operating position (illustrated in FIGS. 9 and 10), in which the passage 15 is in contact with the lid 9 of the carton 1, that is to say, substantially coplanar with the loading table 4, and a raised non-operating position, in which the passage 15 is distanced from the lid 9 (by a rotation—translation movement) to allow both the downfeed of a blank 1*f* from the magazine 13 and movement of the carton 1 previously formed in the direction A following insertion of the row F of products (see arrow F15).

FIGS. 9 and 10 also clearly show the first means 11 for folding the first pair of smaller flaps 7 and 8, which are activated immediately after insertion of the row F of products. The first folding means 11 operate at the loading table 4 to rotate the first pair of a smaller flaps 7 and 8 so as to obtain a first partial closure of the openings 6*a* and 6*b* as the carton 1 moves in direction A.

More specifically, the first folding means 11 comprise two pairs of contact elements 19 (mobile) and 20 (fixed), located on either side of the carton body 6, on the loading table 4.

The first, mobile, pair 19 of contact elements is attached to and projects from either side of a surface 21 which makes contact with one end of the carton body 6 in such a way as to allow the folding of one of the smaller flaps 7 attached to a relative end of the carton body 6 during movement of the surface 21 in the direction of feed A, and by means 22 synchronized with the machine.

The other pair of contact elements 20 form a fixed portal for carton body 6 transit, pushed by the surface 21, to allow folding of the remaining two smaller flaps 8 towards the openings 6*a* and 6*b* in the carton body 6, bringing the carton 1 to the second folding means 12 with the two pairs of flaps 7 and 8 already folded towards the openings 6*a* and 6*b*. The pair of elements 20 (consisting of bars) are suspended vertically so that they do not interfere, during carton 1 movement, with the lids 9 and 10 which are arranged horizontally on the loading table 4.

FIGS. 10 to 16 illustrate the second folding means 12 for the lids 9 and 10. These second folding means 12 are located close to the carton body 6 arriving from the loading table 4 and downstream of the first folding means 11 relative to the direction of feed A.

The second means 12 are structured in such a way as to allow the simultaneous closing rotation of lids 9 and 10 towards the carton body 6, the lids 9 and 10 being retained on the carton body 6, for complete closure of the package.

Starting from the bottom of a carton 1 transit table 26 formed by the horizontal extension of the loading table 4, the second folding means 12 comprise a pair of second levers 23 which simultaneously accompany the lids 9 and 10, parts 24 which simultaneously fold and pick up the free ends 9*a* and 10*a* of the lids 9 and 10 and, finally, parts 25 which press the free ends 9*a* and 10*a*.

Figure 11:
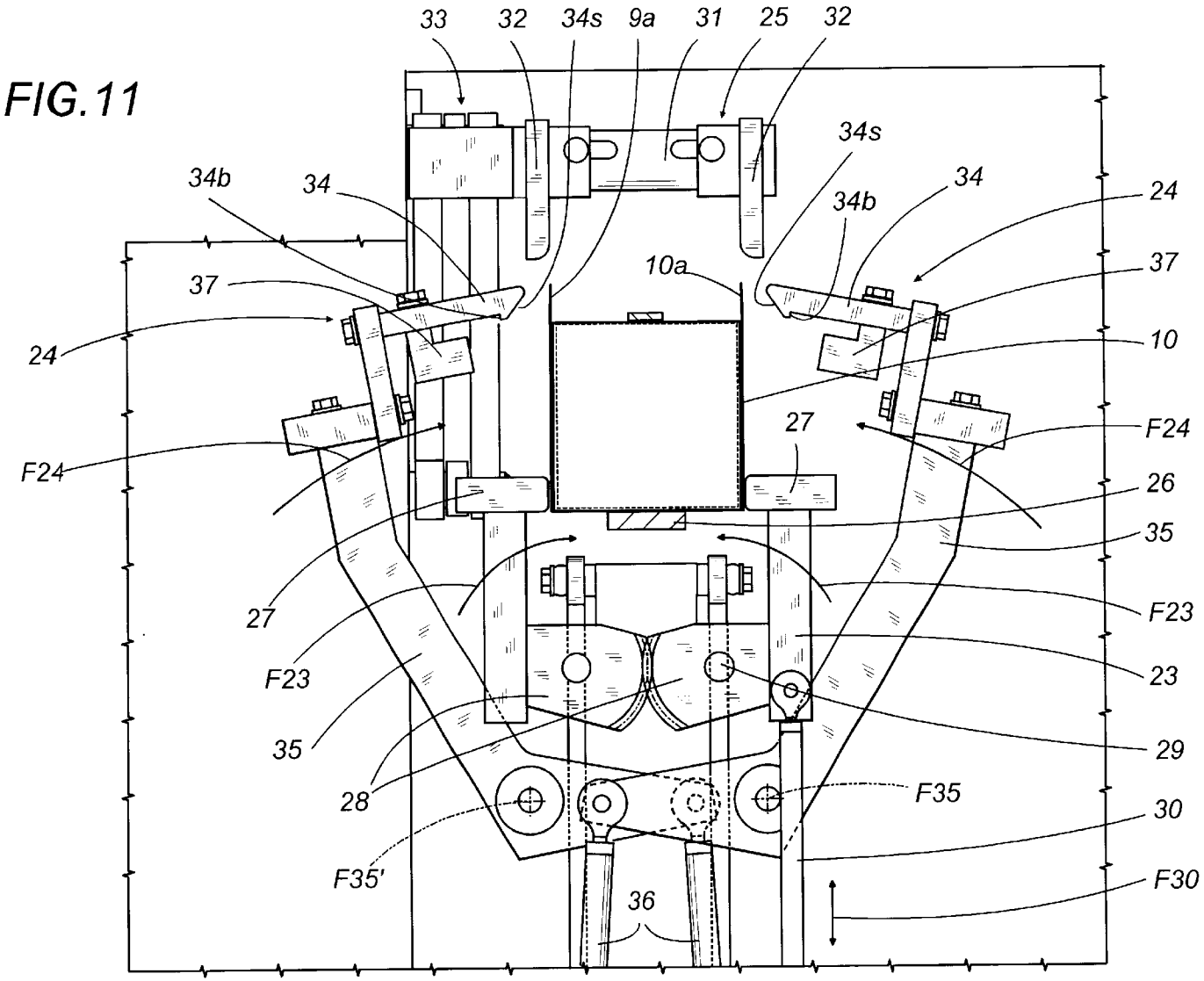
FIG. 11 is a front view from M in FIG. 8 of a second, carton folding, station, which is part of the device illustrated in FIG. 8, in a stage of folding the lids of the carton.
Figure 12:
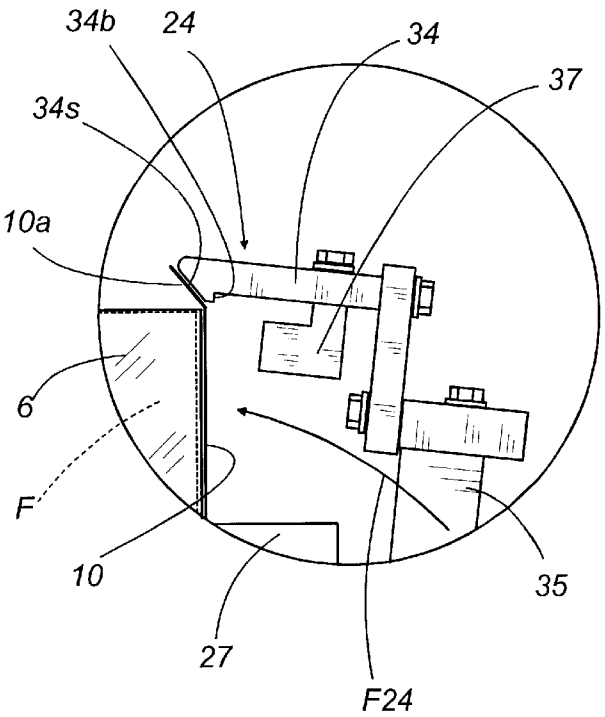
FIG. 12 is a schematic front view of an element of the second station illustrated in FIG. 11 in another stage of folding the lids of the carton.

More specifically, the pair of second levers 23 are located on opposite sides of the carton 1 transit table 26, so that they intercept and accompany, simultaneously and by pushing, the two lids 9 and 10 from their horizontal position to a vertical position in which they make contact with the carton body 6 in such a way as to close the two openings 6*a* and 6*b* (see FIGS. 10 and 11 and arrows F23).

Each second lever 23 comprises, at one end, a pusher head 27 which extends horizontally, positioned parallel with the carton body 6 so that it can push the relative lid 9 and 10 evenly. FIGS. 10, 11, 13 and 14 reveal that the opposite free end of each second lever 23 is attached to a toothed sector 28 linked to a rotary support shaft 29 substantially below the transit table 26.

The two toothed sectors 28 engage with one another to allow simultaneous movement of the second levers 23 by a single first cam drive element 30 connected to one of the second levers 23. The first cam element 30 is schematically illustrated with a portion of lever which is vertically mobile in both directions (see arrow F30), since these mechanisms are of the known type.

Next to the second levers 23 are the above-mentioned parts 24 which simultaneously fold and pick up the free ends of the lids 9 and 10. As already indicated, said ends have a pre-weakened fold line L, so as to form end tabs 9*a* and 10*a*.

The folding and pickup parts 24 rotate between a first, operating end position (see FIGS. 12 and 13 and arrows F24), in which the parts 24 are close to the carton body 6 and simultaneously intercept the ends of the lids 9 and 10, and a second position, in which the end tabs 9*a* and 10*a* thus obtained are pre-inserted in the carton body 6 (see FIGS. 14 and 15 and arrows F24') and in which the parts 24 are distanced from the carton body 6 with simultaneous distancing of the lids 9 and 10 from the openings 6*a* and 6*b* (the Figures illustrate only half of the parts 24, since the structure and movements of the other half mirror the first half).

To form the end tabs 9*a* and 10*a*, the folding and pickup parts 24 comprise a plurality of rods 34, arranged in two sets which are parallel with one another, on opposite sides of the transit table 26 and the carton body 6.

Figure 13:
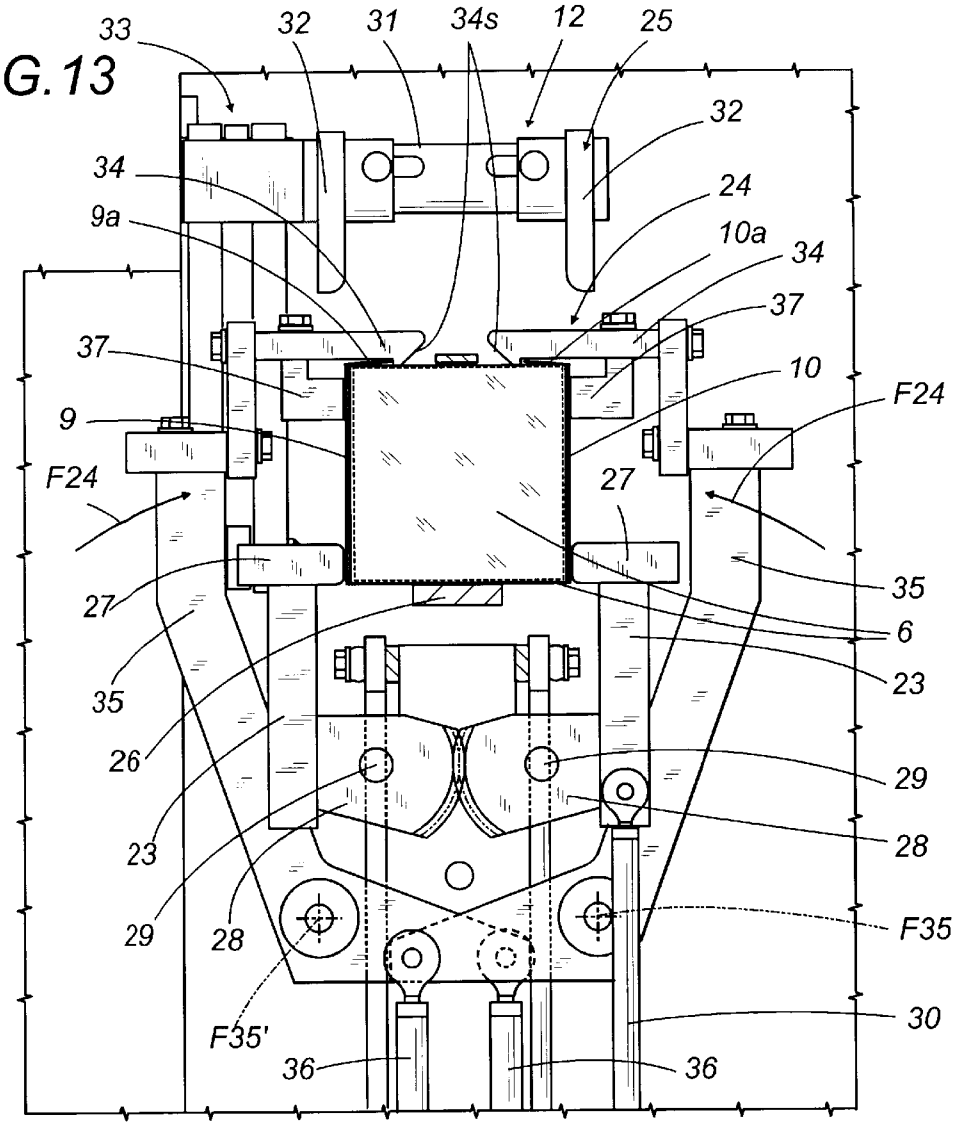
FIG. 13 is a front view of the second station illustrated in FIG. 11, in another stage of closing the carton.

Each rod 34 has a profile 34*s* which makes contact with the end 9*a* and 10*a*, tapered at its free end to intercept and fold the ends 9*a* and 10*a* (see FIG. 12) and shaped, at its center, to form an undercut 34*b* for intercepting the tab 9*a* and 10*a*, in the folded configuration (see FIG. 13).

The ends of the rods 34 are supported by a pair of third levers 35, pivoted at F35 and F35', located on opposite sides of the transit table 26 and designed to move the rods 34 thanks to third cam means 36 connected to the other end of the third levers 35, so as to obtain the above-mentioned succession of rod 34 positions. That is to say: a non-operating position, in which the third levers 35 are distanced from the carton body 6 (see FIGS. 10 and 11); a first operating position, in which the third levers 35 are close to the carton body 6 and the rods 34 fold and intercept the end tabs 9*a* and 10*a* (see FIGS. 12 and 13); and a second operating position, in which the third levers 35 are partially distanced from the carton body 6 in such a way as to move back the relative lid 9 and 10 with the end tab 9*a* and 10*a* folded (see FIG. 14).

The third cam means 36 are illustrated, like the first cam means 30, with two simple rods which drive the respective third lever 35. These rods are, in turn controlled by mechanisms connected to the automatic machine.

Figure 14:
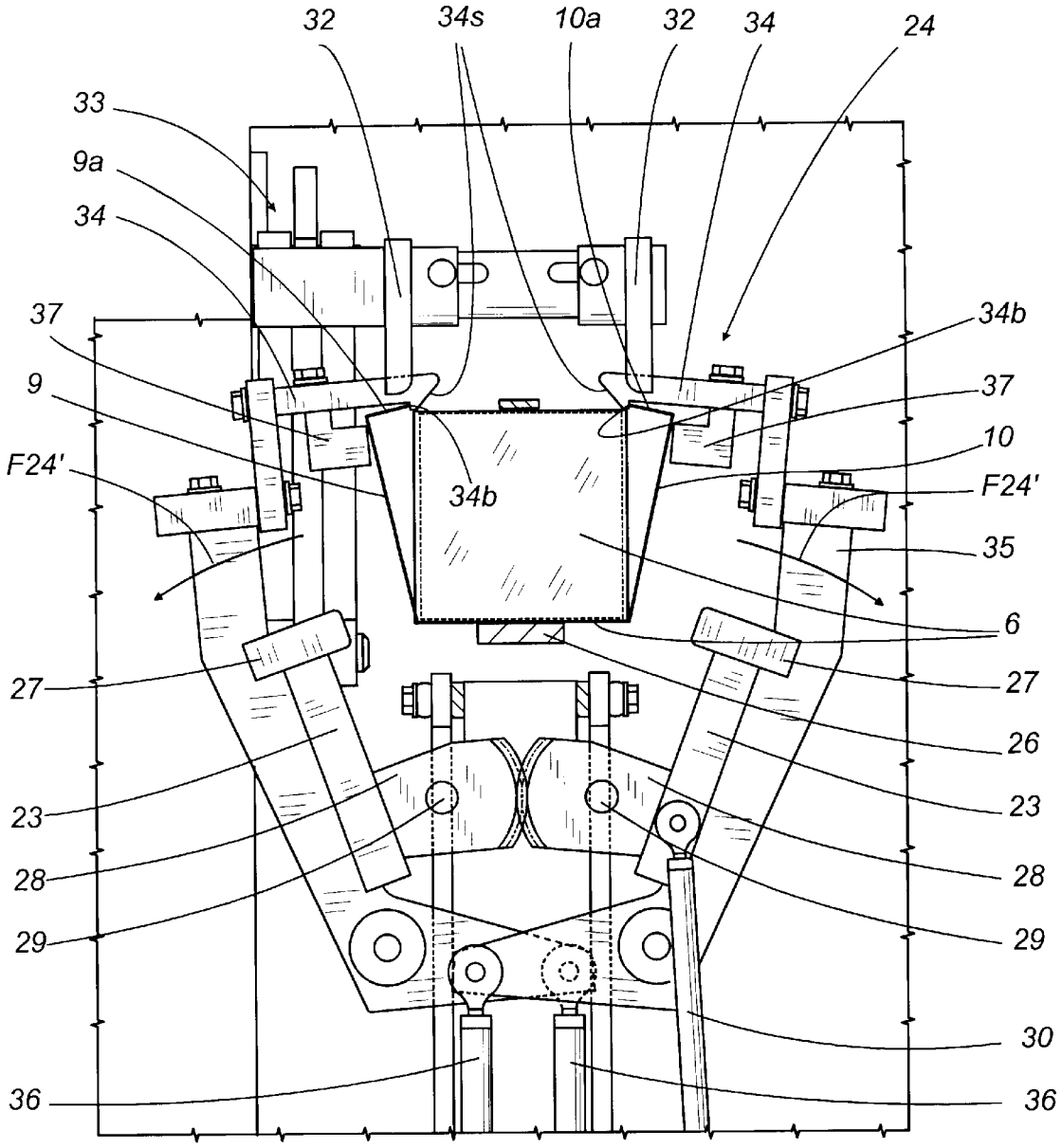
FIG. 14 is a side view of the second station illustrated in the previous figures, in a stage of closing the carton.
Figure 15:
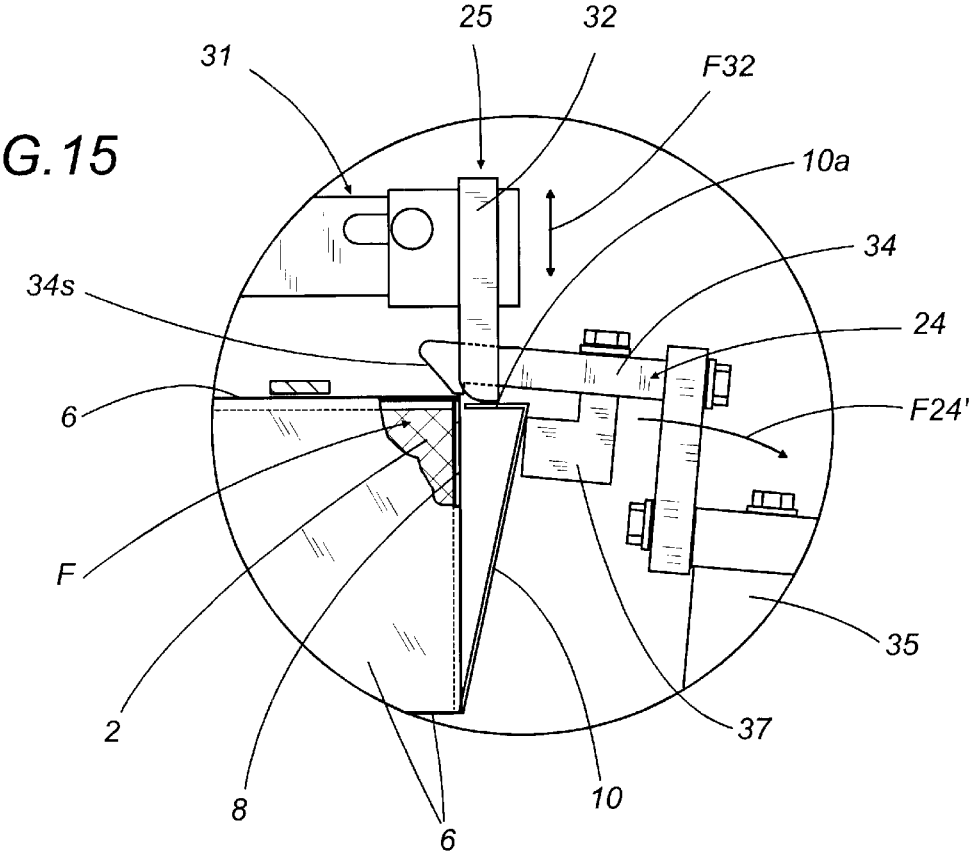
FIGS. 15 and 16 are front views of a detail of the station illustrated in the previous figures, in corresponding stages of complete closure of the carton.

With the end tabs 9*a* and 10*a* in the pre-insertion position illustrated in FIG. 14, the presser parts 25 are activated. These parts are located above the carton body 6 and act on the end tabs 9*a* and 10*a* of the lids 9 and 10, simultaneously angling them towards the openings 6*a* and 6*b* in the carton body 6.

Figure 17:
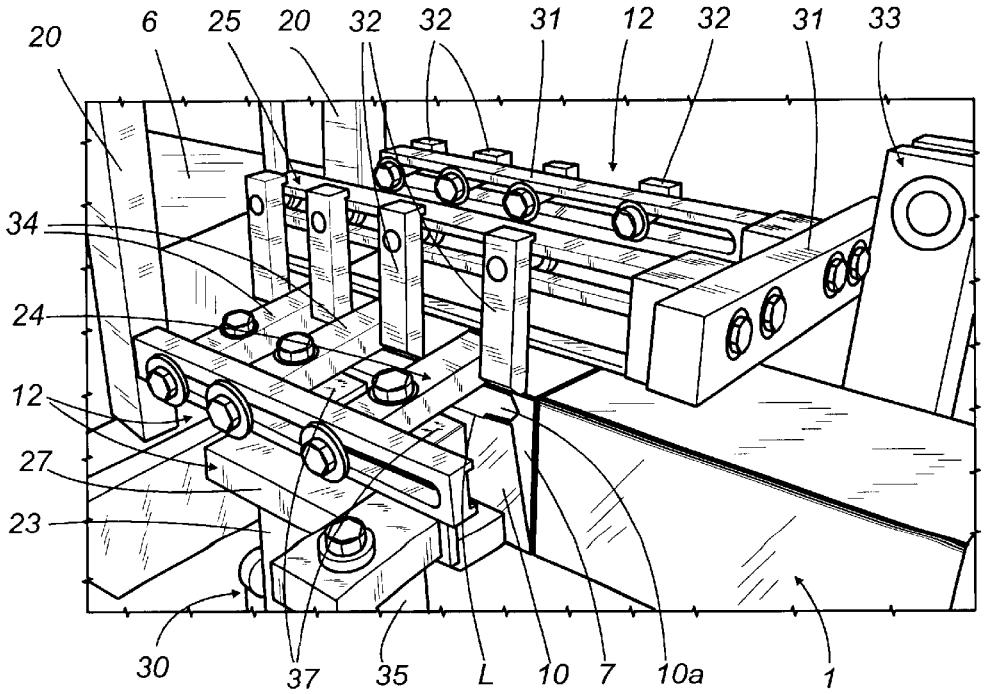
FIG. 17 is a perspective view of the second, folding, station illustrated in the previous figures.

The presser parts 25 comprise a support frame 31 for a plurality of vertical pins 32 placed parallel with one another in two rows, in such a way that they are on opposite sides of and above the carton body 6. For correct operation, the pins 32 and rods 34 must be alternated (see also FIGS. 8, 17 and 18) and neither must interfere with the movements of the other.

The frame 31 is connected to second cam means 33 (similar to the previous in structure and, therefore, not fully illustrated) which drive the frame 31. The frame moves between a raised non-operating position (see FIG. 14), in which the pins 32 are distanced from the end tabs 9*a* and 10*a*, and a lowered operating position, in which the pins 32 make contact with the end tabs 9*a* and 10*a*, folding them further, so as to bring them into a position in which they are inserted in the relative openings 6*a* and 6*b* (see FIG. 15 and arrows F32).

The tabs 9*a* and 10*a* are actually inserted by the folding and pickup parts 24 with a further rotation towards the carton body 6.

Figure 16:
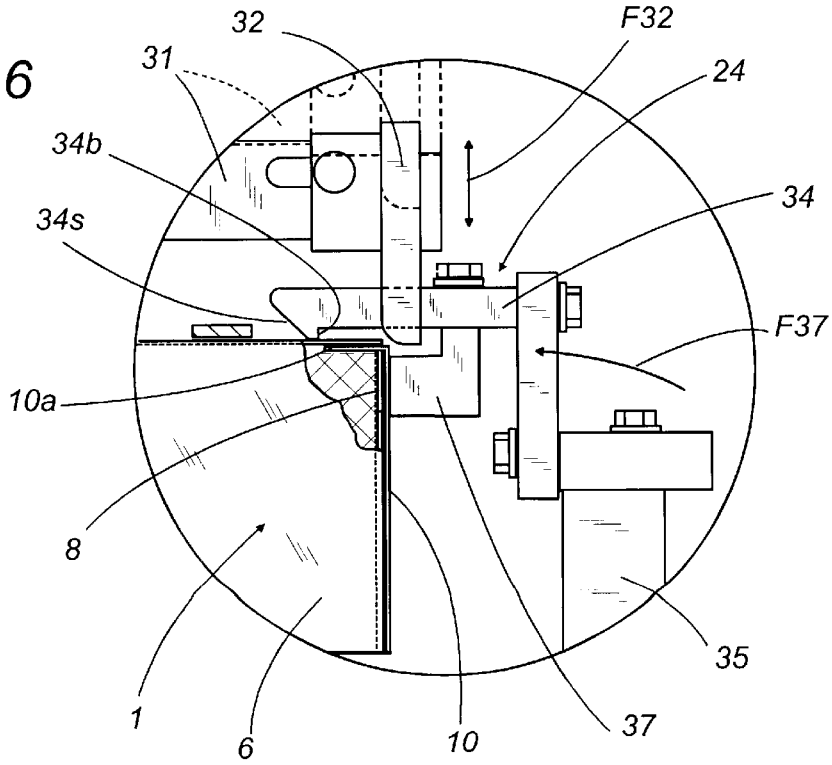

As illustrated in FIG. 16, each third lever 35, constituting the parts 24, comprises a rod 37, extending horizontally, positioned below the rods 34, and designed to allow a thrust which accompanies the end tab 9*a* and 10*a* into the opening 6*a* and 6*b* at a third operating position for the pair of third levers 35, in which the third levers 35 are again brought close to the carton body 6 (see arrow F37 in FIG. 16).

At this point the carton 1 is completely closed and is fed further along the transit 26 table, from which it is unloaded manually or using an automatic handling system (not illustrated here) by means of the thrust from another carton being formed (to be closed) which is fed along the loading table 4.

The method and device described, therefore, fulfil the preset aims thanks to a series of stages which are extremely simple, rapid and can be performed in a limited space.

Similarly, the device which implements this method is compact and can, therefore, be adapted to any type of automatic machine with an average level of production.

The construction architecture of the operating units, some specular, allows rapid carton forming with precision, safe operations, resulting in a high-quality finished product.

The invention described can be subject to modifications and variations without thereby departing from the scope of the inventive concept. Moreover, all the details of the invention may be substituted by technically equivalent elements.

What is claimed is:

1. A method for packaging ordered groups of filter bags containing doses of products for infusion comprising at least a station for forming a group of a preset number of filter bags arranged in a row, the method comprising:

simultaneously feeding one carton at a time, in the form of a flat pre-folded blank, on a loading table and opening the blank to form a tubular carton body, having two opposite openings, one on either side, two first pairs of smaller moving by a rotation and translation movement the end of a passage between a lowered operating position in which the passage is substantially coplanar with the loading table to feed the row of products into the carton body through one opening of the carton body positioned opposite the end of the passage for the row of products, allowing the row of products to be fed into the carton body in a direction of feed perpendicular to a preset direction of movement of the carton, and a raised non operating position in which the passage is distanced from the carton;

folding the two pairs of smaller flaps, as the carton is fed in the preset direction, to form a first partial closure of the openings; and closing the carton body on said loading table, by simultaneously folding the pair of lids towards the two openings so as to obtain a closed package.

2. The method according to claim 1, wherein the feed step is performed by picking up an individual flat pre-folded blank from a stack of flat pre-folded blanks.

3. The method according to claim 1, wherein the step of folding the first pair of smaller flaps is performed as a result of and during carton feed in a direction perpendicular to the direction of feed of the row of products.

4. The method according to claim 1, wherein the step of closing the carton body comprises: simultaneously folding the pair of lids by rotating them from a position in which the lids are horizontal and distanced from the carton body to a position in which the pair of lids is substantially vertical and in contact with the carton body; simultaneously folding the free ends of each of the lids, having a pre-weakened fold line, thus forming an end tab which is inserted in the carton body and is at an angle to the rest of the lid; simultaneously distancing the lids from the carton body, by performing a rotation which is opposite to said folding rotation movement; simultaneously pressing the pair of end tabs and maintaining their position with respect to the lids; and simultaneously moving the lids towards the carton body, inserting the tabs in the openings in the carton body to close the carton.

5. The method according to claim 1, wherein the step of folding the first pair of smaller flaps envisages a first folding rotation, simultaneous and by contrast, of one flap in each pair, located on one side of the carton body, and a second folding rotation, again by contrast and simultaneous with said translation, of the other flap in each pair, located on the opposite side of the carton body.

6. A device for packaging ordered groups of filter bags containing doses of products for infusion comprising at least a station for forming a group of a preset number of filter bags arranged in a row, the device comprising:

means for forming an individual tubular carton body which is fed in the form of a flat pre-folded blank from a magazine and onto a loading table in such a way as to obtain the carton body with two opposite openings, one on either side, to which two pairs of flaps and a pair of lids are attached, the carton body being in an open configuration to allow insertion of at least one row of products, one of the openings of the carton body being positioned opposite the end of a passage for the row of products, to allow the row of products to be fed into the carton body in a direction of feed perpendicular to the direction of carton feed; the passage presenting a pair of lateral walls adapted to be in contact with the flaps and being mobile by a rotation and translation movement between a lowered operating position, in which the passage is positioned on a lid of the carton and coplanar with the loading table and in which the lateral walls keep the flaps open, and a raised non-operating position, in which the passage is distanced from the lid;

first means for folding the two pairs of smaller flaps, operating at the loading table and designed to allow the two pairs of smaller flaps to rotate in such a way as to obtain a first partial closure of the openings as the carton is fed in a preset direction; and second means for folding the lids, being located close to the carton body and downstream of the first folding means relative to the direction of feed, and being designed to allow at least a simultaneous closing rotation of the lids towards the carton body, the lids being attached to the carton body in such a way as to form a closed package.

7. The device according to claim 6, wherein the means for forming the carton body comprise a suction cup unit for picking up the flat pre-folded blank from a stack of blanks, and a rigid rod used to erect the individual blank on the loading table.

8. The device according to claim 7, wherein the suction cup unit comprises a support arm which is free at least at one end, at least one pair of suction cups for picking up the blank from the stack, the arm being controlled by a four-bar linkage allowing the arm to move in both directions between a pickup end position, in which the pair of suction cups makes contact with a blank on the stack, and a release position, in which the pair of suction cups is below the loading table, releasing the blank onto the table.

9. The device according to claim 7, wherein the rigid rod has a shaped extension forming a guide close to the loading table, is designed to intercept the flat pre-folded blank during its downfeed from the magazine, and allows part of the surface of the carton body to be rotated upwards.

10. The device according to claim 6, wherein the first folding means comprises two pairs of fixed and mobile contact elements positioned on either side of the carton body resting on the loading table, wherein a first, mobile pair of the contact elements is attached to and projects from either side of a surface which makes contact with one end of the carton body, allowing folding of the two smaller flaps attached to one end of the carton body, as the surface moves in the direction of feed, by relative means which are synchronized with the machine, and wherein the other pair of contact elements forms a fixed portal for the passage of the carton body, allowing folding of the remaining two smaller flaps towards the openings in the carton body as the carton body moves towards the second folding means.

11. The device according to claim 6, wherein the second folding means comprises at least one pair of second levers which simultaneously push the lids from a substantially horizontal position to a substantially vertical position in which they are in contact with the carton body to close the openings.

12. The device according to claim 6, wherein the second folding means comprises parts for simultaneously folding and picking up the ends of the lids and is located on opposite sides of the carton body to form relative end tabs which are angled towards the carton body.

13. The device according to claim 6, wherein the second folding means comprises presser parts positioned above the carton body and acting on end tabs of the lids when in a vertical configuration to angle the end tabs towards the carton body along a pre-weakened fold line on each of the lids to close the openings.

14. The device according to claim 6, wherein the second folding means comprises:

a pair of second levers on opposite sides of a carton transit table, the levers being an extension of the loading table and being designed to allow the lids to be simultaneously pushed from a substantially horizontal position to a substantially vertical position in which they are in contact with the carton body and close the openings;

parts for simultaneously folding and picking up the free ends of the lids with a pre-weakened fold line to form end tabs, the parts being mobile between a first, operating position, in which the parts are close to the carton body and simultaneously intercept the ends of the lids, and a second position, in which the end tabs obtained are in a pre-insertion configuration and in which the parts are distanced from the carton body and simultaneously move the lids back away from the openings; and presser parts, above the carton body and acting on the end tabs of the lids, in the pre-insertion configuration, and being able to simultaneously angle the relative end tabs towards the corresponding openings in the carton body in which they are inserted by subsequent movements of the folding and pickup parts towards the carton body.

15. The device according to claim 14, wherein each of the second levers comprises:

one end having a pusher head extending horizontally, parallel with the carton body, to push the associated lid; and an opposite end being attached to a toothed sector connected to a rotary support shaft and being substantially below the transit table wherein each toothed sector engages with the other to allow simultaneous movement of the second levers upon activation of a single first cam drive means connected to one of the second levers.

16. The device according to claim 14, wherein the presser parts comprise a support frame for a plurality of vertical pins that are parallel with one another in two rows such that they are on opposite sides of and above the carton body but do not interfere with the folding and pickup parts, and wherein the frame is connected to second cam means which moves the frame between a raised non-operating position, in which the pins are distanced from the end tabs, and a lowered operating position, in which the pins make contact with the end tabs.

17. The device according to claim 14, wherein the folding and pickup parts comprise a plurality of rods, arranged in two set which are parallel with one another and on opposite sides of the transit table and the carton body, each rod having a surface which makes contact with the tab, the surface being shaped and designed to form an undercut for intercepting the end tab, in the folded configuration, of the corresponding lid.

18. The device according to claim 17, wherein the folding and pickup parts comprise a pair of third levers positioned on opposite sides of the transit table, each of which pivot at and support one of the set of rods at one end, the other end being controlled by third cam means designed to allow movement between at least a non-operating position, in which the third levers are distanced from the carton body, a first operating position, in which the third levers are close to the carton body and the rods intercept the end tabs, and a second operating position, in which the third levers are partially distanced from the carton body, in such a way as to pull back the relative lid with folded end tab.

19. The device according to claim 18, wherein said third levers each comprise a rod element, extending horizontally and located below the rods, which thrusts the end tab into the relative opening when the pair of third levers is in a third operating position, in which the third levers are again moved towards the carton body.

* * * * *